US007896675B2

(12) United States Patent
Hemmi et al.

(10) Patent No.: US 7,896,675 B2
(45) Date of Patent: Mar. 1, 2011

(54) CONNECTOR CONNECTION TERMINAL COMPRISING A POINTED PORTION FORMED THROUGH ELECTROFORMING AND CONNECTOR INCORPORATING THE SAME

(75) Inventors: Yoshinobu Hemmi, Otsu (JP); Hirotada Teranishi, Kusatsu (JP); Tadayuki Sakase, Ritto (JP); Jiro Koyama, Otsu (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 12/572,166

(22) Filed: Oct. 1, 2009

(65) Prior Publication Data

US 2010/0081299 A1 Apr. 1, 2010

(30) Foreign Application Priority Data

Oct. 1, 2008 (JP) ..... 2008-256696

(51) Int. Cl.
*H01R 13/15* (2006.01)

(52) U.S. Cl. ..... 439/260

(58) Field of Classification Search ..... 439/260, 439/494–496, 259
See application file for complete search history.

(56) References Cited

U.S. PATENT DOCUMENTS

| | | | | |
|---|---|---|---|---|
| 7,044,773 | B2 * | 5/2006 | Suzuki et al. | 439/495 |
| 7,393,239 | B2 * | 7/2008 | Suzuki et al. | 439/495 |
| 7,435,122 | B2 * | 10/2008 | Suzuki et al. | 439/260 |
| 7,621,768 | B2 * | 11/2009 | Suzuki et al. | 439/260 |
| 2007/0202736 | A1 | 8/2007 | Takashita | |

FOREIGN PATENT DOCUMENTS

JP 2007-227302 A 9/2007

OTHER PUBLICATIONS

English abstract for Japanese Publication No. 2007-227302 published on Sep. 6, 2007, 1 page.

* cited by examiner

*Primary Examiner*—Chandrika Prasad
(74) *Attorney, Agent, or Firm*—Osha Liang LLP

(57) ABSTRACT

A connector connection terminal has a fixed piece to be inserted to a base of a connector, a coupling portion extending from the fixed piece, and a movable piece extending in parallel to the fixed piece to both sides from a free end of the coupling portion and being operated by an operation lever rotatably assembled to the base. At least one of the fixed piece and the movable piece includes at least one pointed portion. The connector connection terminal is formed through electroforming.

15 Claims, 13 Drawing Sheets

CONNECTOR CONNECTION TERMINAL COMPRISING A POINTED PORTION FORMED THROUGH ELECTROFORMING AND CONNECTOR INCORPORATING THE SAME

BACKGROUND OF INVENTION

1. Technical Field

The present invention relates to connector connection terminals, and in particular, to a connector connection terminal for connecting a flexible print substrate.

2. Related Art

Conventionally, a connector connection terminal includes an electrical connector for connector connection terminal incorporated in a planar circuit substrate in which a terminal, which is obtained by processing a metal plate while maintaining a plate surface of the metal plate, is held in plurals by a housing with a spacing in a direction orthogonal to the plate surface, the terminal having a projection formed at the opposing edges of two arm bodies substantially parallel to each other, and the distance between the projections of the two arm bodies being elastically narrowed by applying an external force to the terminal to electrically connect a planar circuit substrate and the terminal while sandwiching the planar circuit substrate between the projections, where the projection of at least one of the arm bodies forms a sharp pointed portion (see Japanese Unexamined Patent Publication No. 2007-227302).

In recent years, the electrical connector is used in devices such as a portable telephone and a portable game machine, but further miniaturization is demanded on the electrical connector with miniaturization of these devices. For instance, in a certain electrical connector, the height dimension of the insulating housing is smaller than or equal to 1 mm, a conductive thin plate having a plate thickness of smaller than or equal to 0.2 mm is used for the connector connection terminal incorporated in the electrical connector, and great number of connector connection terminals are arranged in the housing at a pitch of between 0.3 and 0.5 mm.

With demands of further miniaturization and lowering in height on the electrical connector, further miniaturization and lowering in height are also demanded on the connector connection terminal incorporated in the electrical connector, and thus miniaturization and lower height are also relatively demanded on the sharp pointed portion of the connector connection terminal.

SUMMARY

However, there is a limit to lowering the height and miniaturizing the sharp pointed portion since the connector connection terminal is normally manufactured by punching out the conductive thin plate through press working. When attempting to form the sharp pointed portion through press working, the press operation step of at least two times is required, and the productivity is low.

One or more embodiments of the present invention provides a connector connection terminal in which the number of operation steps is few, the productivity is high, and miniaturization and lowering in height can be realized.

One or more embodiments of the present invention relates to a connector connection terminal including a fixed piece to be inserted to a base of a connector, a coupling portion extending from the fixed piece, and a movable piece extending in parallel to the fixed piece to both sides from a free end of the coupling portion and being operated by an operation lever rotatably assembled to the base, wherein at least one of the fixed piece and the movable piece includes at least one pointed portion; and the connector connection terminal is formed through electroforming.

According to one or more embodiments of the present invention, since the pointed portion can be formed through electroforming, a connector connection terminal having a lowered height and being miniaturized can be obtained with few number of operation steps.

In one aspect of the present invention, the connector connection terminal formed with a cutout may be obtained.

According to such aspect, the height can be lowered and slip-out can be prevented by curving the flexible print substrate at the cutout, and thus high reliability is obtained.

In particular, as the edge on one side of the cutout is the pointed portion and the flexible print substrate is locked to the pointed portion, the height can be lowered while further enhancing the contact reliability.

In another aspect of the present invention, an aspect ratio of a cross-sectional area of a bottom of the cutout may be greater than or equal to 1.2.

According to such aspect, further lowering in height and miniaturization can be realized since the cross-sectional area of the bottom of the cutout can be thinned.

In another further aspect of the present invention, a plurality of pointed portions may be arranged side by side to form a saw-tooth shape.

According to such aspect, the positioning task of the flexible print substrate is facilitated since the flexible print substrate can be locked and connected with a plurality of pointed portions.

In still another aspect of the present invention, a thickness of the pointed portion may be thinner than a main body of the connector connection terminal.

According to such aspect, if a connection pad at the connection portion of the flexible print substrate is densely arranged side by side, the pointed portion does not contact the adjacent connection pad and the short circuit does not occur even if the positioning accuracy in the width direction of the connector connection terminal varies. Thus, the flexible print substrate does not require high positioning accuracy, and the connection task can be facilitated.

In particular, in another further aspect of the present invention, a step may be formed on one surface of the pointed portion for thinning, or a step may be formed on both surfaces of the pointed portion for thinning.

Since the step is merely formed on one surface of the pointed portion, the manufacturing is easy. The one-side contact of the pointed portion with respect to the flexible print substrate does not occur and the torsion moment does not act on the pointed portion by forming the step on both surfaces of the pointed portion.

Furthermore, the thickness of the pointed portion may be thinned by gradually reducing the thickness of the main body of the connector connection terminal.

According to such aspect, the manufacturing of the die of electroforming is facilitated than when forming a step at the pointed portion.

A connector according to one or more embodiments of the present invention has a configuration of incorporating the connector connection terminal, and operating the same with an operation lever.

According to one or more embodiments of the present invention, a miniaturized connector of lower height can be obtained by incorporating the miniaturized connector connection terminal of lower height to the base.

Other aspects and advantages of the invention will be apparent from the following description and the appended claims.

DETAILED DESCRIPTION

Figure 1A:
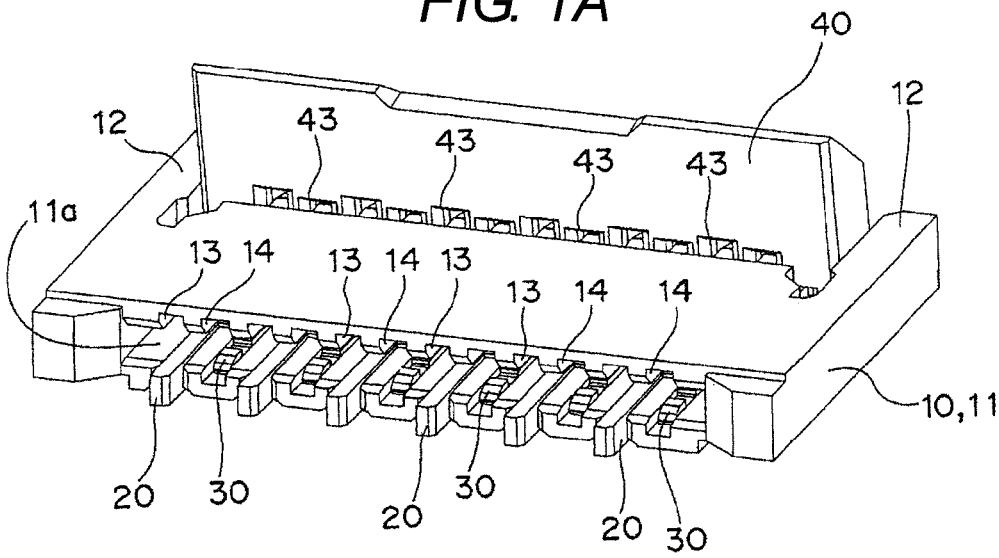
FIGS. 1A to 1C are perspective views showing a connector incorporating a first embodiment of a connector connection terminal according to one or more embodiments of the present invention seen from different angles.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Hereinafter, preferred embodiments of the present invention will be described with reference to FIG. 1 to FIG. 11.

As shown in FIG. 1 to FIG. 8, the first embodiment is a case applied to a connector 10 for connecting a flexible print substrate 50. The connector 10 broadly includes a base 11, a first connection terminal 20, a second connection terminal 30, and an operation lever 40.

Figure 1B:
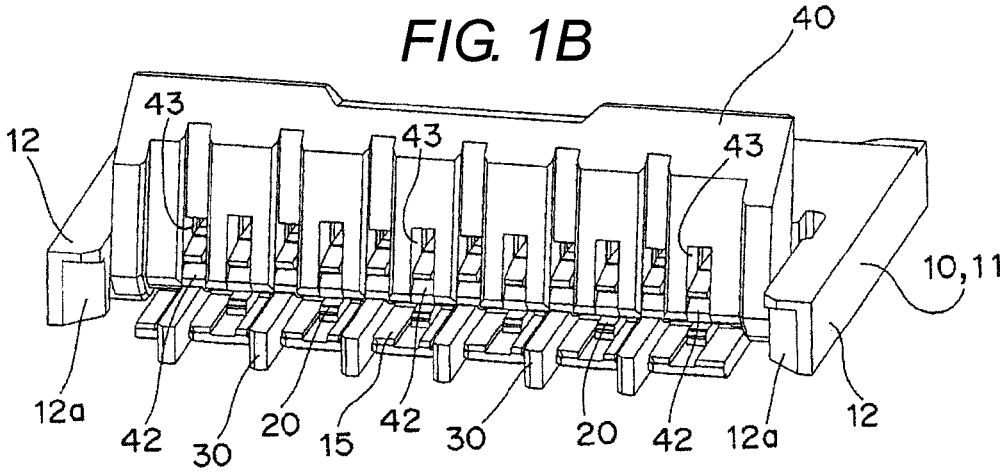
Figure 1C:
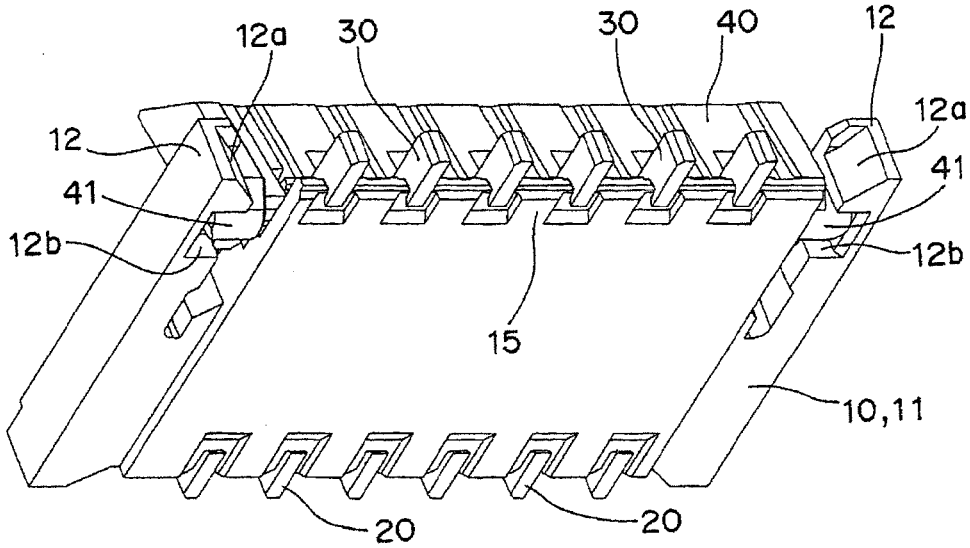

As shown in FIGS. 1A to 1C, the base 11 has elastic arms 12, 12 extending in parallel to the rear surface side from an edge on one side of both side end surfaces. In an inward surface of the elastic arm 12, a guide tapered surface 12*a* is formed at a distal end edge and a bearing slit 12*b* is formed on the far side. The base 11 includes, on a front surface side, an opening 11*a* to which a distal end of the flexible print substrate 50, to be hereinafter described, can be inserted, where a first insertion hole 13 passing from the front surface to the rear surface is arranged side by side at a predetermined pitch. The base 11 has a guide plate 15 extending between the elastic arms 12, 12 from the edge on the lower side of the rear surface, and second insertion holes 14 arranged side by side at positions adjacent to the first insertion holes 13.

As shown in FIGS. 4A to 4E, the first connection terminal 20 includes a fixed piece 21 to be inserted and fixed to the first insertion hole 13 of the base 11, a coupling portion 22 arranged in a projecting manner at the upper side of the fixed piece 21, and a movable piece 23 extending substantially parallel to the fixed piece 21 to both sides from the upper end of the coupling portion 22, and has a thickness of 0.1 mm, for example.

The fixed piece 21 has a locking nail 24 for locking and positioning to the edge of the base 11 at one end on the lower side, and a cutout 25 and a slip-out preventing projection 26 on the upper side with the coupling portion 22 in between. A pointed portion 27 is formed by arranging the cutout 25. The aspect ratio of the cross-sectional area of the bottom part of the cutout 25 is between 1.2 and 4, and preferably between 1.5 and 3. If smaller than 1.2, the desired pointed portion 27 is not easy to form, and if greater than 4, the desired strength is not obtained.

Through the formation of the first connection terminal 20 according to the present embodiment through electroforming, to be hereinafter described, the pointed end portion 27 of the desired angle can be manufactured with one electroforming step, so that a plurality of press operation steps are not necessary as in the press working.

The coupling portion 22 couples the fixed piece 21 with the movable piece 23 and rotatably supports the movable piece 23, where the aspect ratio at the cross-sectional area thereof is between 1.2 and 4, and preferably between 1.5 and 3. If smaller than 1.2, a definite change is not found in the improvement of the operation force and the contact force, and if greater than 4, the desired durability is not obtained.

Figure 6A:
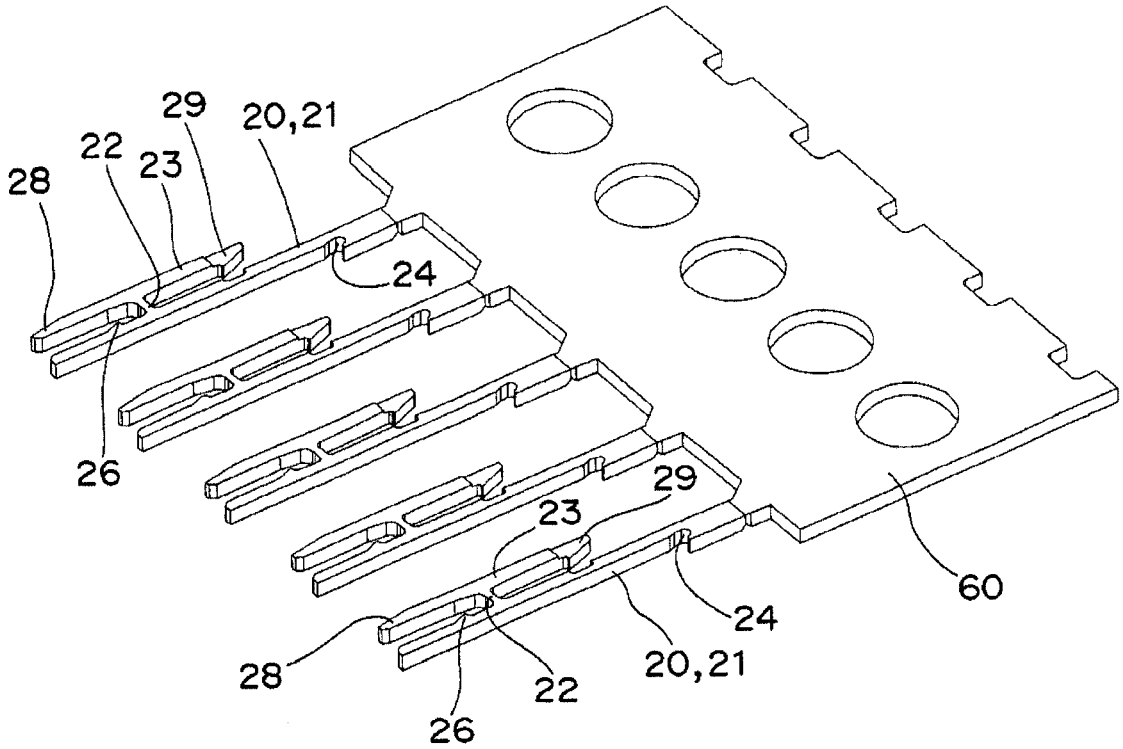
FIG. 6A is a perspective view describing a manufacturing method of the first connection terminal.

The manufacturing method of the first connection terminal 20 having such aspect ratio includes an electroforming method of simultaneously manufacturing a hoop material 60, as shown in FIG. 6A The electroforming method electrodeposits the metal to the portion not covered with an insulating film of the bottom surface of a cavity of a master block by applying voltage between the mother block (not shown) and the opposing electrode. When current is flowed, the metal also is electrodeposited on the insulating film covering one part of the bottom surface. In this case, the metal layer covering the insulating film grows with a delay from the metal layer electrodeposited on the portion not covered with the insulating film. That is, the irregular surface and the tapered surface of the first connection terminal 20 are formed by the irregularities of the cavity surface of the master block and the presence of the insulating film.

The material of the first connection terminal 20 is required not only to enable the desired shape and physicality to be obtained, but also that the electroforming solution is less likely to be subjected to alteration. Thus, the material of the first connection terminal 20 may be nickel-silver alloy, nickel-tungsten alloy, nickel-cobalt alloy, nickel-palladium alloy, and the like in addition to copper elemental substance and nickel elemental substance.

The movable piece 23 has one end as an operation receiving portion 28 and the other side arranged with a first movable contact 29 projecting to the lower side. The first movable contact 29 has a pointed portion. The first movable contact 29 is arranged immediately above the cutout 25, and the thickness dimension thereof is one step thinner than the thickness dimension of the entire movable piece 23. This is because if the thickness dimension of the first movable contact 29 of the first connection terminal 20 is small, the first movable contact 29 is less likely to come in contact with a first connection pad 52 arranged at a connection portion 51 of the flexible print substrate 50 and a lead wire 54 of an adjacent second connection pad 53 shown in FIG. 6B even if the assembly accuracy of the first connection terminal 20 varies, and the possibility of short circuit is reduced. Thus, high assembly accuracy is not required for the assembly task, and the productivity is enhanced.

The first movable contact 29 may not only be thinned by arranging a step difference on one surface and may be thinned by arranging a step difference on both surfaces, or the width dimension of the first movable contact 29 may be gradually thinned by forming a tapered surface.

As shown in FIGS. 5A to 5E, the second connection terminal 30 includes a fixed piece 31 to be inserted to and fixed to the second insertion hole 14 of the base 11, a coupling portion 32 arranged in a projecting manner at the upper side of the fixed piece 31, and a movable piece 33 extending substantially parallel to the fixed piece 31 to both sides from the upper end of the coupling portion 32.

The manufacturing method, the material, and the thickness of the second connection terminal 30 are similar to the first connection terminal 20, and thus the description thereof will not be given.

The fixed piece 31 has a locking nail 34 for locking and positioning to the edge of the base 11 at one end on the lower side, and a cutout 35 and a slip-out preventing projection 36 on the upper side with the coupling portion 32 in between. A pointed portion 37 is formed by arranging the cutout 35. The slip-out preventing projection 36 is formed on a bulging portion 36*a* bulging out in the plate thickness direction.

The aspect ratio of the cross-sectional area of the bottom part of the cutout 35 is between 1.2 and 4, and preferably between 1.5 and 3. If smaller than 1.2, the desired pointed end portion is not easy to form, and if greater than 4, the desired strength is not obtained. The second connection terminal 30 having such aspect ratio is manufactured through the electroforming method, similar to the first connection terminal 20.

The coupling portion 32 couples the fixed piece 31 with the movable piece 33 and rotatably supports the movable piece 33, where the aspect ratio at the cross-sectional area thereof is between 1.2 and 4, and preferably between 1.5 and 3. If smaller than 1.2, a definite change is not found in the improvement of the operation force and the contact force, and if greater than 4, the desired durability is not obtained.

The movable piece 33 has one end as an operation receiving portion 38 and the other end arranged with a second movable contact 39 projecting to the lower side. The second movable contact 39 has a pointed portion. The second movable contact 39 is arranged immediately above the cutout 36.

Figure 11:
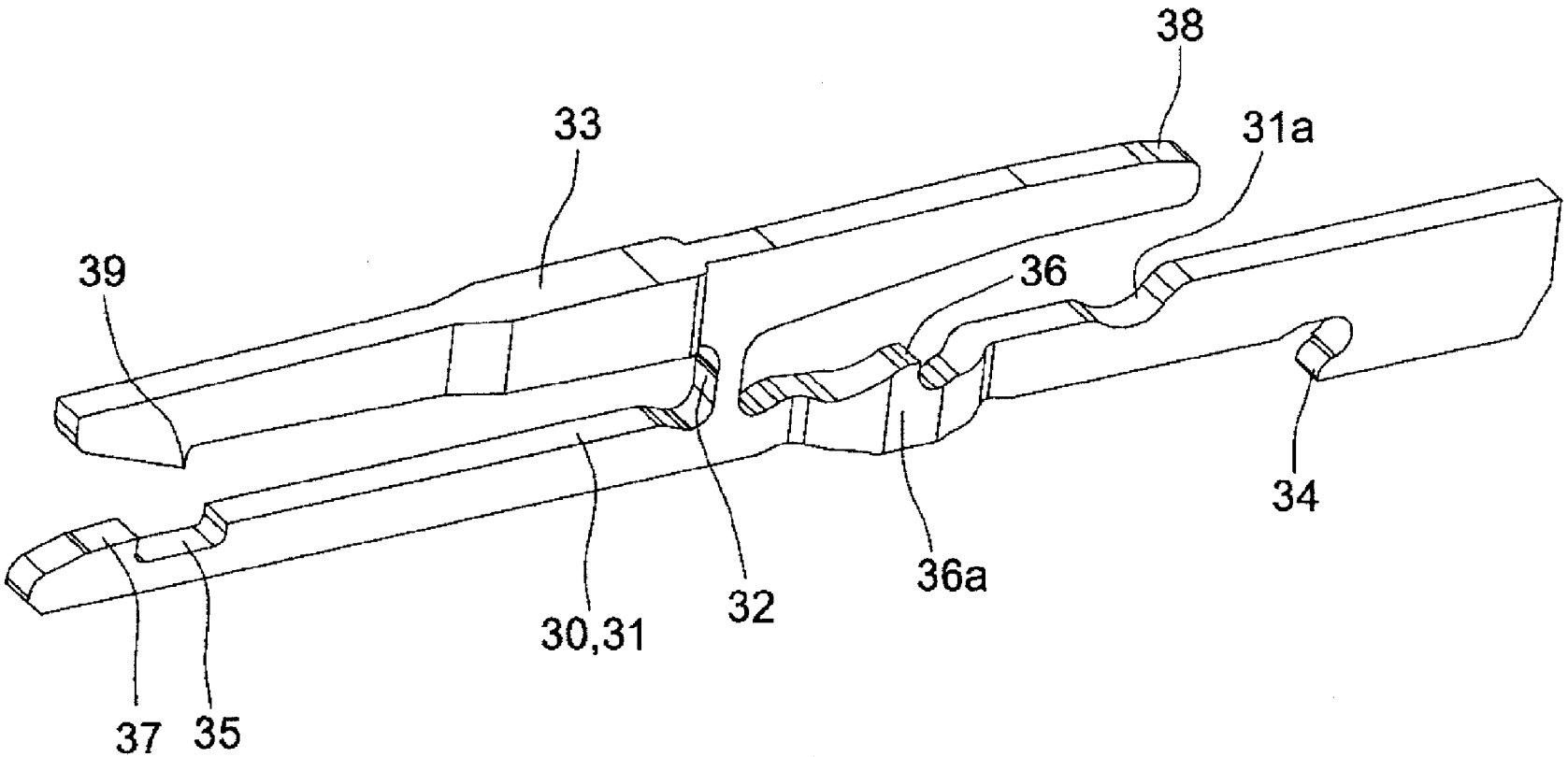
FIG. 11 is a perspective view showing a variant of the second connection terminal.

The second connection terminal 30 does not necessarily need to have a uniform thickness, and the vicinity of the coupling portion 32 of the movable piece 33 may be formed thicker than other portions as shown in FIG. 11. According to the present embodiment, the second moment of area of the movable piece 33 becomes large and the rigidity becomes large, and thus a large contact force is obtained.

Although not shown in FIG. 11, the fixed piece 31 may also not have a uniform thickness, and only the bulging portion 36*a* may be formed thick. According to the present embodiment, the entire second connection terminal 30 is less likely to slip out, and the holding strength is enhanced.

Figure 3:
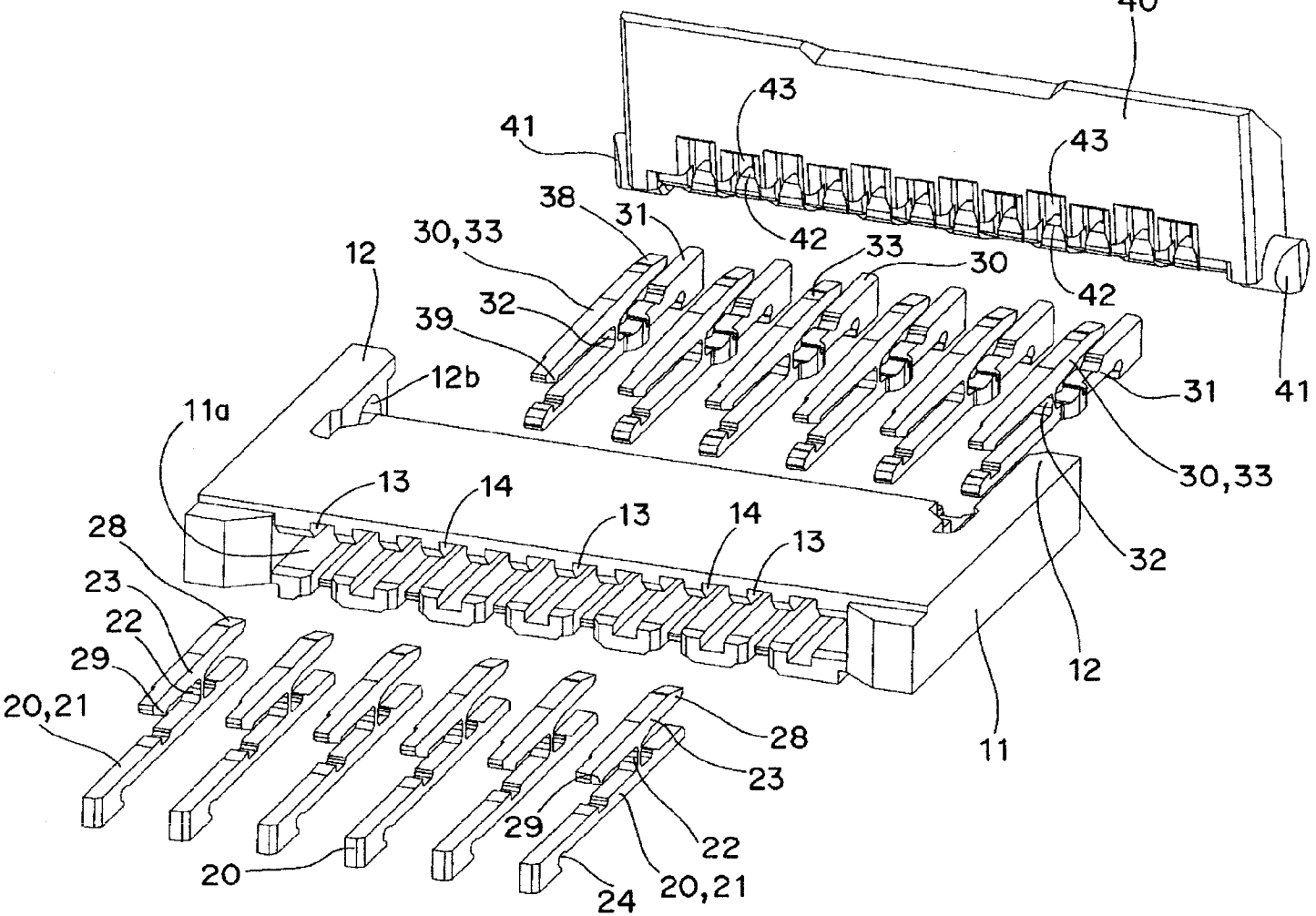
FIG. 3 is an exploded perspective view of the connector shown in FIGS. 1A to 1C.
Figure 4A:
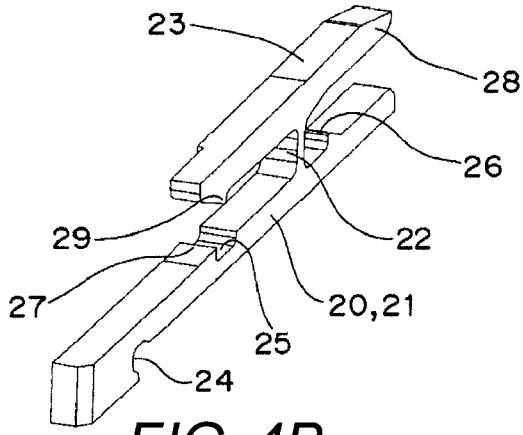
FIGS. 4A to 4E are a perspective view, a perspective view seen from a different angle, a plan view, a front view, and a bottom view of a first connection terminal shown in FIG. 3.
Figure 4B:
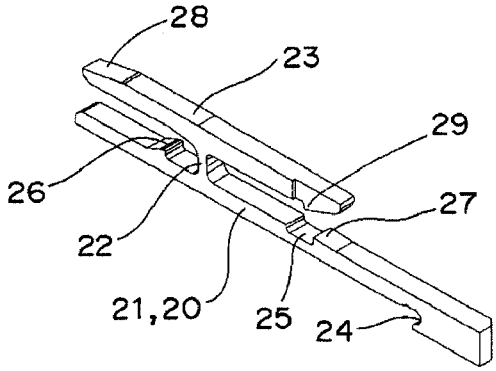
Figure 4C:
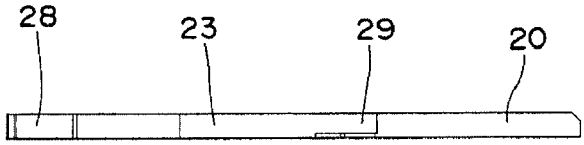
Figure 4D:
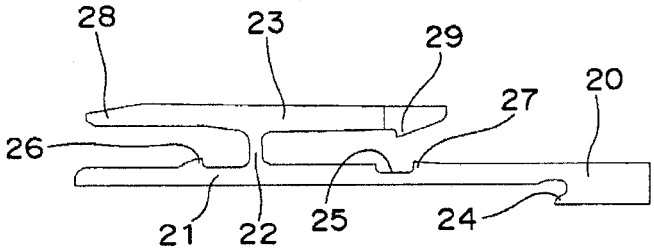
Figure 4E:
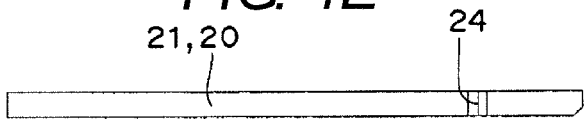
Figure 5A:
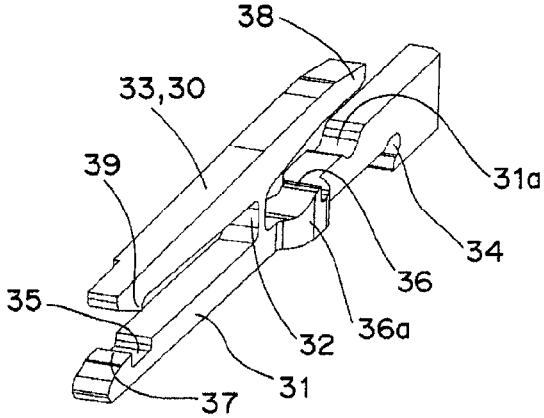
FIGS. 5A to 5E are a perspective view, a perspective view seen from a different angle, a plan view, a front view, and a bottom view of a second connection terminal shown in FIG. 3.
Figure 5B:
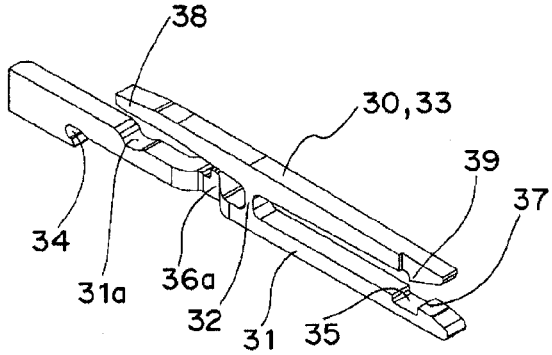
Figure 5C:
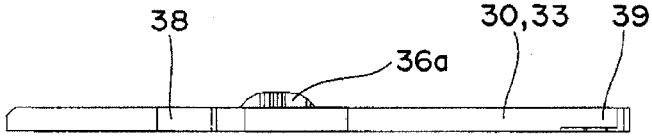
Figure 5D:
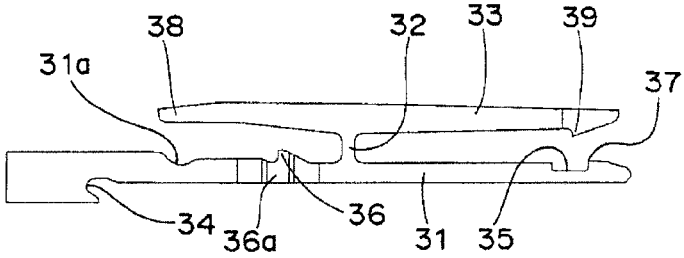
Figure 5E:
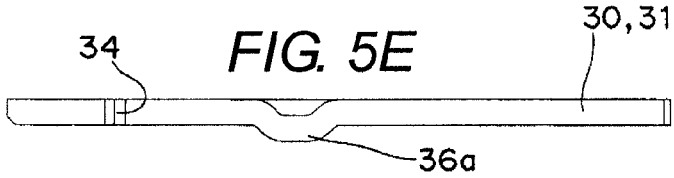

As shown in FIG. 3, the operation lever 40 has turning shaft parts 41, 41 arranged in a projecting manner on the same axis center on both side end surfaces. The operation lever 40 has a cam portion 42 for operating the operation receiving portions 28, 38 of the first and second connection terminals 20, 30 arranged at a predetermined pitch on the edge on one side, and a through-hole 43 to which the operation receiving portions 28, 38 are inserted is arranged at a position corresponding to the cam portion 42.

Figure 6B:
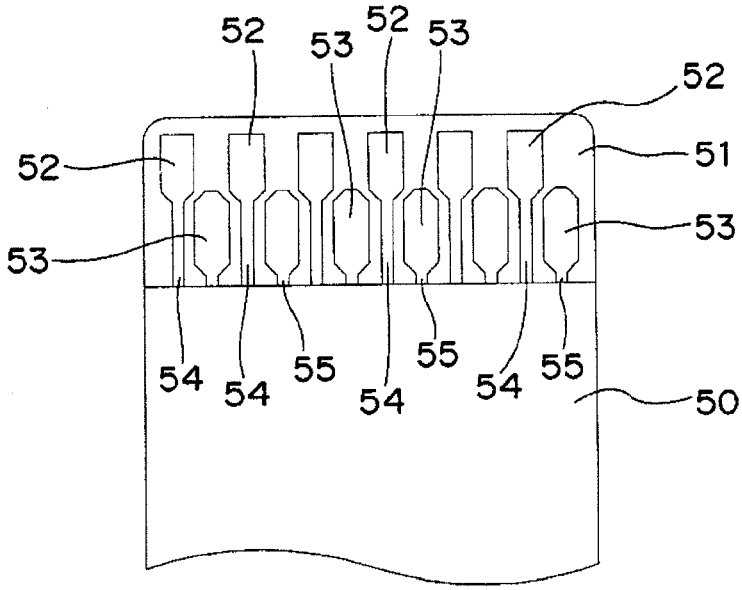
FIG. 6B is a partial plan view of a print substrate to be connected.

As shown in FIG. 6B, the flexible print substrate 50 to be connected to the connector 10 according to the present embodiment has first and second connection pads 52, 53, which are print wired on the upper surface of the distal end 51, alternately arranged in a zigzag manner. Lead wires 54, 55 are connected to the first and second connection pads 52, 53.

The assembly method of the configuring parts described above will now be described.

Figure 7A:
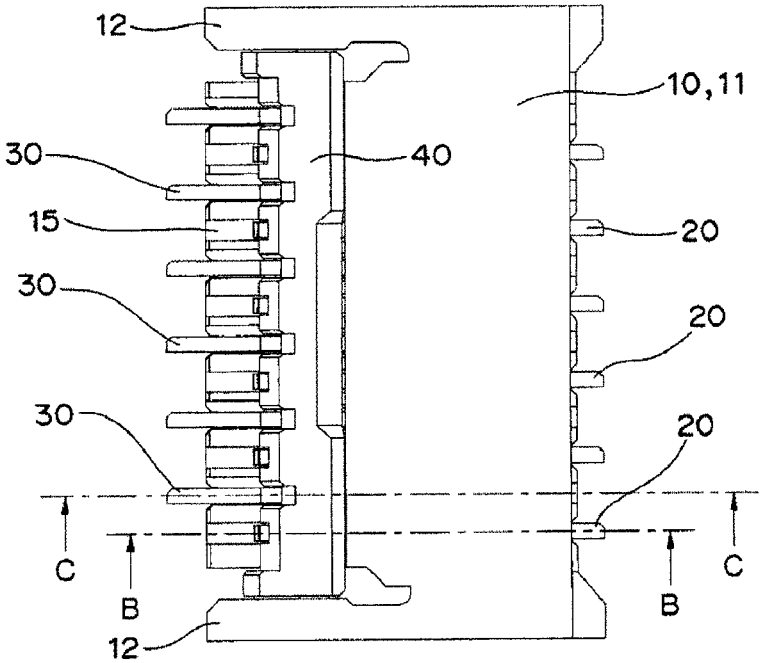
FIG. 7A is a plan view showing before connection of the connector incorporating the connector connection terminal according to the first embodiment.
Figure 7B:
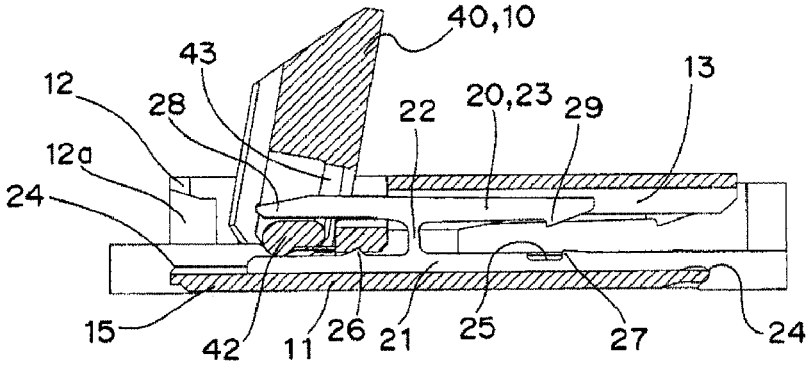
FIGS. 7B and 7C are cross-sectional views taken along the lines B-B and C-C, respectively, of FIG. 7A.
Figure 7C:
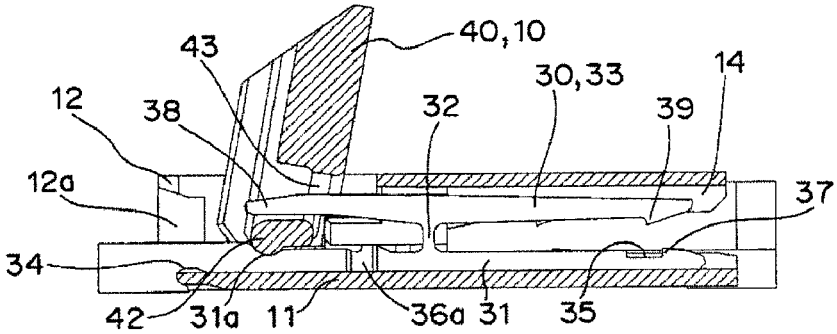

First, one end of the first connection terminal 20 is inserted to the first insertion hole 13 from the opening 11*a* on the front surface side of the base 11. The slip-out preventing projection 26 of the first connection terminal 20 thus locks to the roof surface of the slip-out preventing portion of the base 11, and the locking nail 24 locks to and is positioned at the edge of the base 11 (FIGS. 7A to 7C).

The one end of the second connection terminal 30 is inserted to the second insertion hole 14 along the guide plate 15 of the base 11. Thus, the slip-out preventing projection 36 arranged on the bulging portion 36*a* of the second connection terminal 30 locks while pushing and spreading in the up and down direction. At the same time, the locking nail 34 locks to and is positioned at the edge of the base 11.

The operation receiving portions 28, 38 of the first and second connection terminals 20, are inserted to the through-holes 43 of the operation lever 40, the operation lever 40 is slipped along the upper surface of the fixed piece 31 of the second connection terminal 30, and the operation receiving portions 28, 38 are pushed up and pushed in while being elastically deformed with the cam portion 42. Therefore, the cam portion 42 is fitted to a bearing portion 31*a* of the second connection terminal 30, and the turning shaft part 41 is fitted to the bearing slit 12*b* of the base 11, whereby the operation lever 40 is rotatably supported.

The method of connecting and fixing the flexible print substrate 50 to the connector 10 will be described based on FIGS. 2A, 2B and FIGS. 8A to 8C.

Figure 2A:
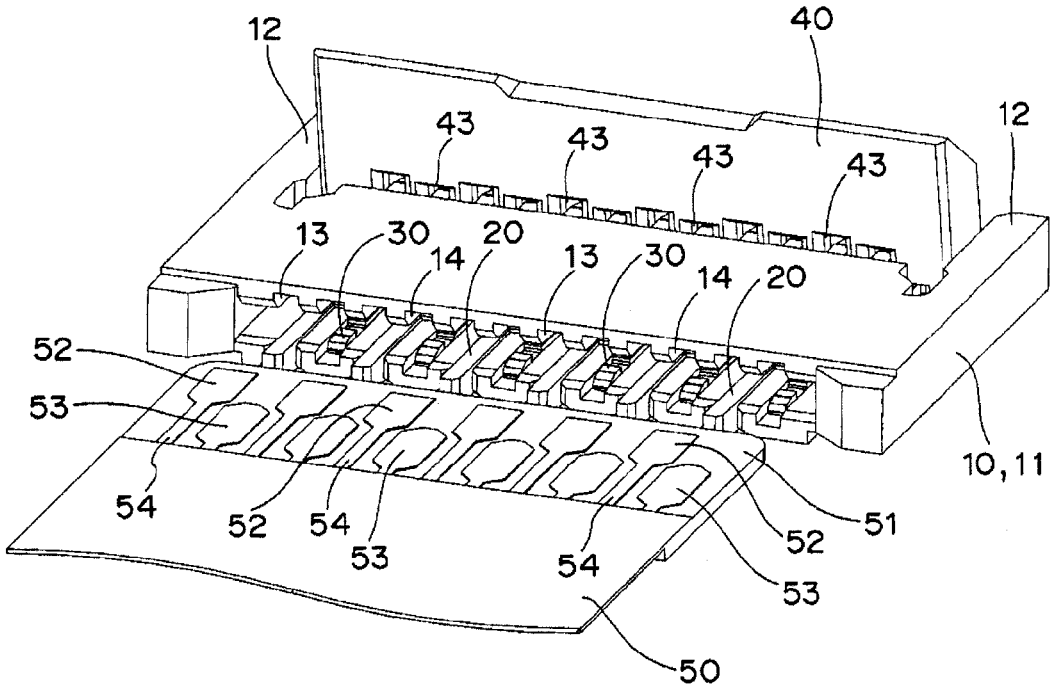
FIGS. 2A and 2B are perspective views showing before and after connection of the connector incorporating the connector connection terminal shown in FIGS. 1A to 1C.
Figure 2B:
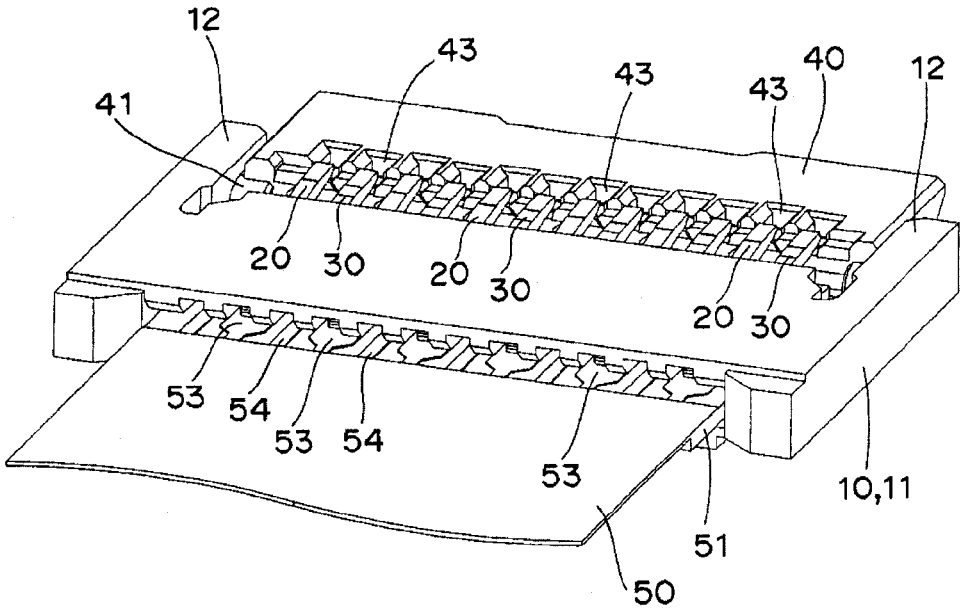
Figure 8A:
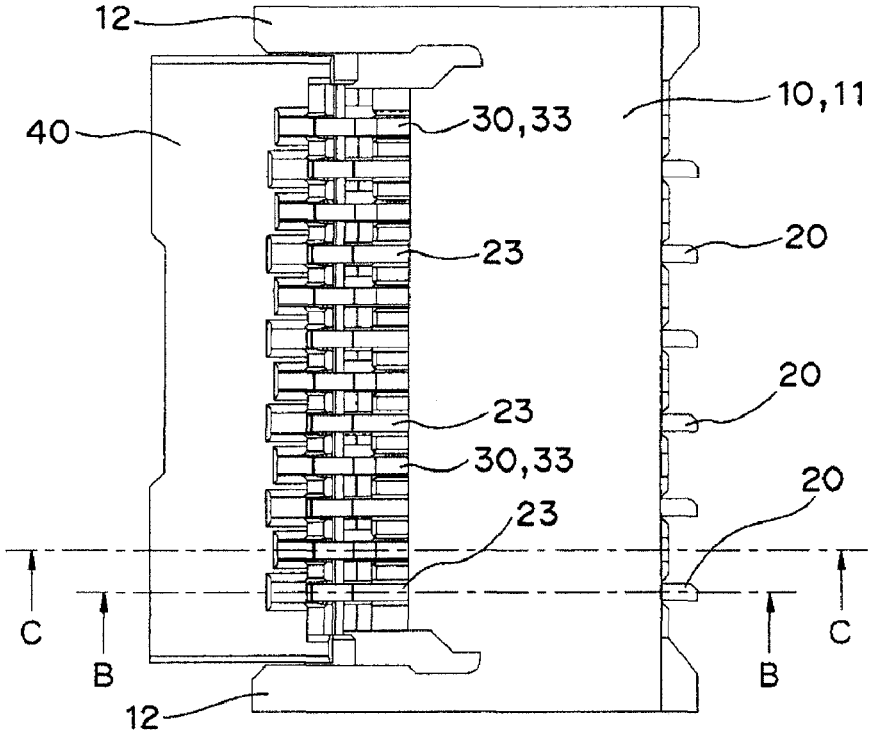
FIG. 8A is a plan view showing after connection of the connector incorporating the connector connection terminal according to the first embodiment.
Figure 8B:
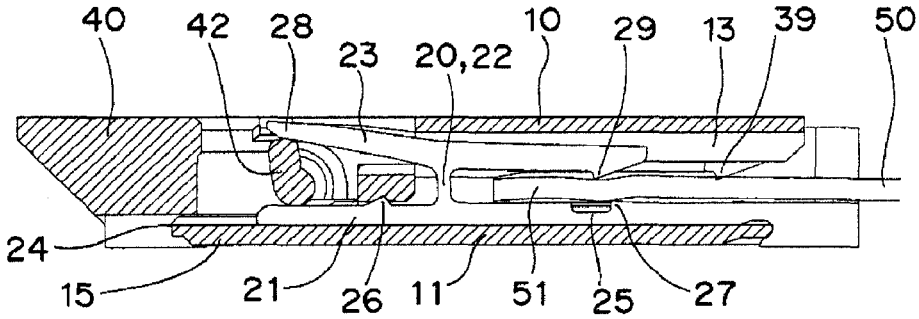
FIGS. 8B and 8C are cross-sectional views taken along the lines B-B and C-C, respectively, of FIG. 8A.
Figure 8C:
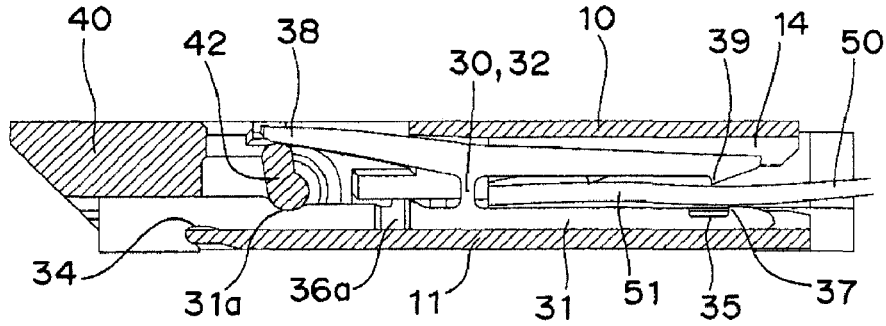

As shown in FIGS. 2A and 2B, the connection portion 51 of the flexible print substrate 50 is inserted to the opening 11*a* of the base 11 until hitting the inner side surface of the base 11. When the operation lever 40 is turned and pushed down with the axis center of the turning shaft part 41 as the center, the cam portion 42 simultaneously pushes up the operation receiving portions 28, 38 of the first and second connection terminals 20, 30, as shown in FIGS. 8A to 8C. Thus, the movable pieces 23, 33 tilt with the coupling portions 22, 32 as the supporting point, and the first and second movable contacts 29, 39 pressure contact and conduct with the first and second pads 52, 53 arranged at the connection portion 51 of the flexible print substrate 50.

In the present embodiment, the first and second movable contacts 29, 39 not only push down and curve the connection portion 51 of the flexible print substrate 50, but the first and second movable contacts 29, 39 and the pointed portions 27, 37 respectively bite into the front and back surfaces of the flexible print substrate 50 and prevent slipping out, so that high contact reliability can be ensured.

When detaching the flexible print substrate 50 from the connector 10, the cam portion 42 is inverted by turning the operation lever 40 in the opposite direction, and the bending moment on the operation receiving portions 28, 38 of the first and second connection terminals 20, 30 is released. After releasing the connection state of the first and second movable contacts 29, 39 with respect to the first and second connection pads 52, 53, the flexible print substrate 50 is pulled out.

According to the present embodiment, since the first and second connection pads 52, 53 of the flexible print substrate 50 are arranged in a zigzag manner, as shown in FIG. 6B, the mounting density becomes higher, miniaturization is more easily realized, and the contact reliability is enhanced.

The first and second movable contacts 29, 39 of the first and second connection terminals 20, 30 have a narrow width. Thus, even if the assembly accuracy varies, the second movable contact 39 of the second connection terminal 30 is less likely to come in contact with the lead wire 54 of the first connection portion 52 and the second connection portion 53 of the flexible print substrate 50, and short circuit is less likely to occur.

Figure 9A:
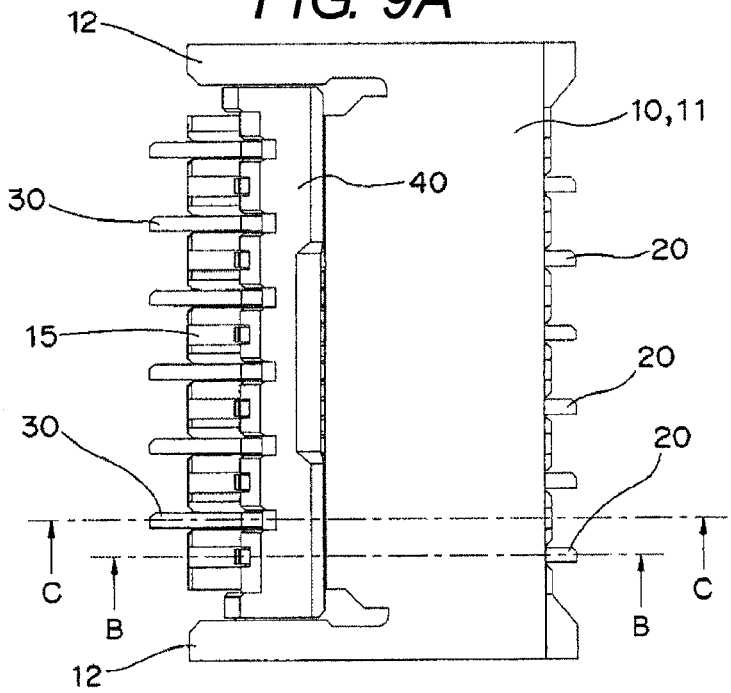
FIG. 9A is a plan view showing a connector incorporating a connector connection terminal according to a second embodiment.
Figure 9B:
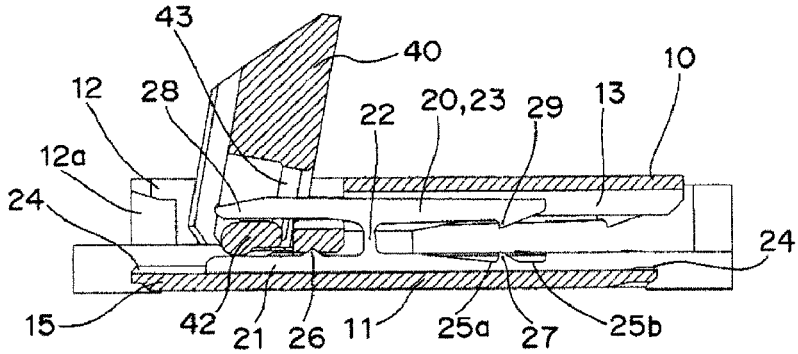
FIGS. 9B and 9C are cross-sectional views taken along the lines B-B and C-C, respectively, of FIG. 9A.
Figure 9C:
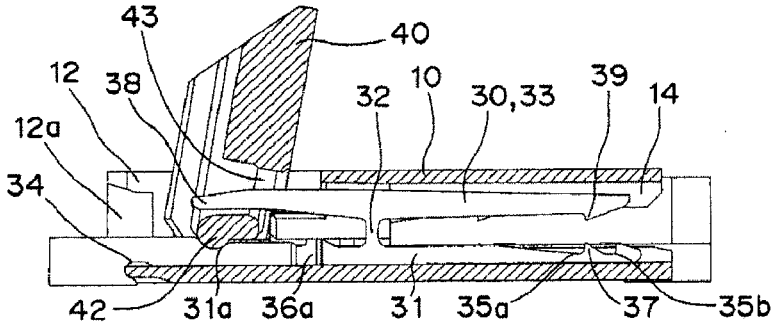

As shown in FIGS. 9A to 9C, a second embodiment is a case in which the pointed portions 27, 37 are formed by arranging a pair of cutouts 25*a*, 25*b*, and 35*a*, 35*b* on the upper side of the fixed pieces 21, 31 of the first and second connection terminals 20, 30. Others are similar to the first embodiment described above, and thus the description thereof will not be given.

According to the present embodiment, the pointed end portions 27, 37 of an acute angle are obtained and dropping is less likely to occur, whereby the connection reliability is further enhanced.

Figure 10A:
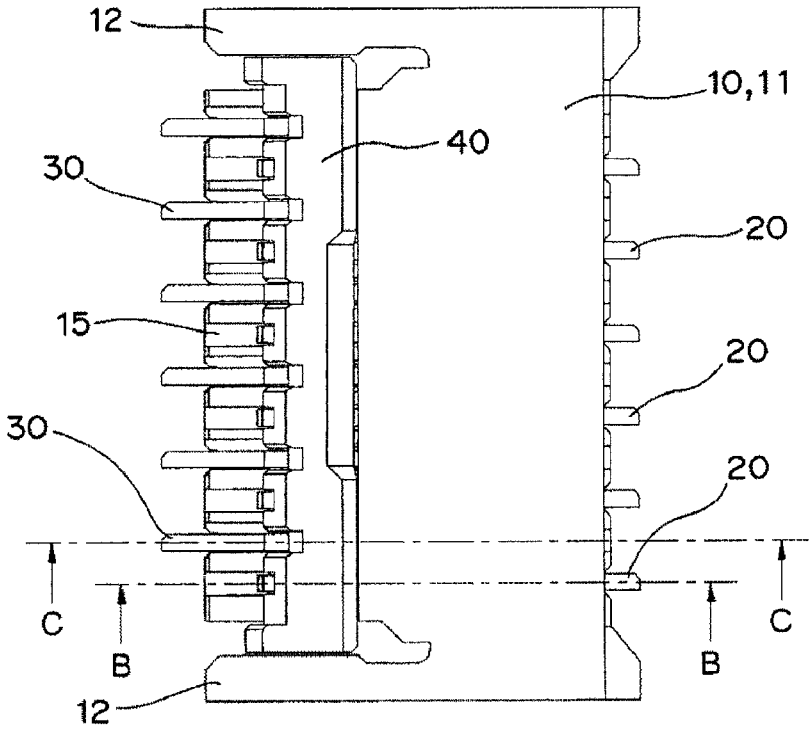
FIG. 10A is a plan view showing a connector incorporating a connector connection terminal according to a third embodiment.
Figure 10B:
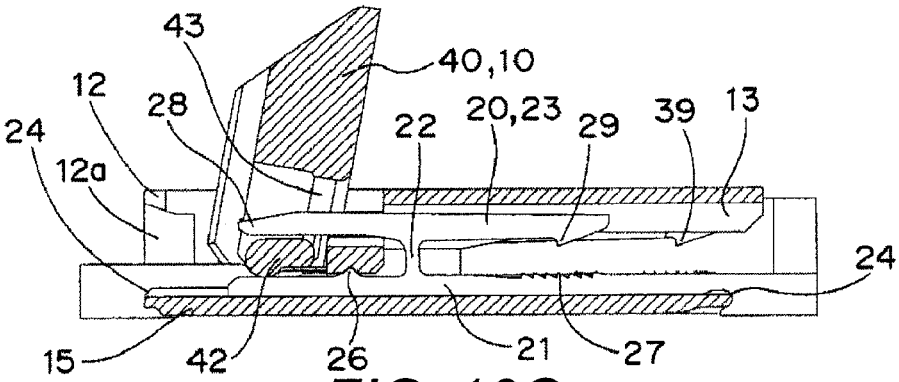
FIGS. 10B and 10C are cross-sectional views taken along the lines B-B and C-C, respectively, of FIG. 10A.
Figure 10C:
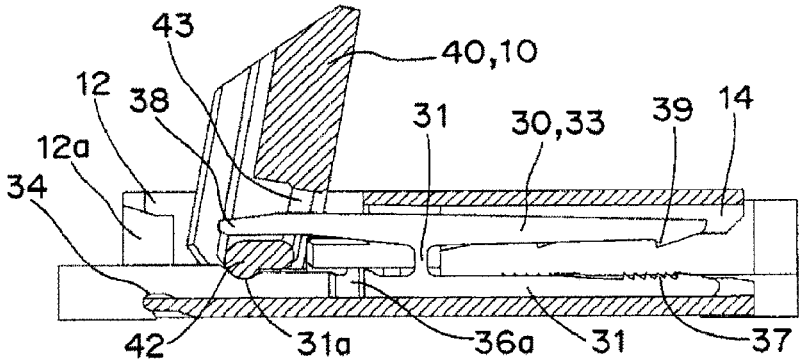

As shown in FIGS. 10A to 10C, a third embodiment is a case where the pointed portions 27, 37 of saw-tooth shape are formed on the upper side of the fixed pieces 21, 31 of the first and second connection terminals 20, 30. Others are similar to the first embodiment, and thus the description thereof will not be given.

According to the present embodiment, the alignment with the first and second movable contacts 29, 39 is facilitated, and high dimensional accuracy is not required by forming the pointed portions 27, 37 of saw-tooth shape. Thus, the manufacturing of the first and second connection terminals 20, 30 is facilitated, and the productivity is enhanced.

In regards to the first connection terminal 20, with the cross-sectional area of the coupling portion 22 as the aspect ratio 2 (first example) and the aspect ratio 1 (first comparative example), the operability in a case where the operation receiving portion 28 was operated with the operation lever 40 is simulated. The calculation result is shown in FIGS. 12A and 12B.

Figure 12A:
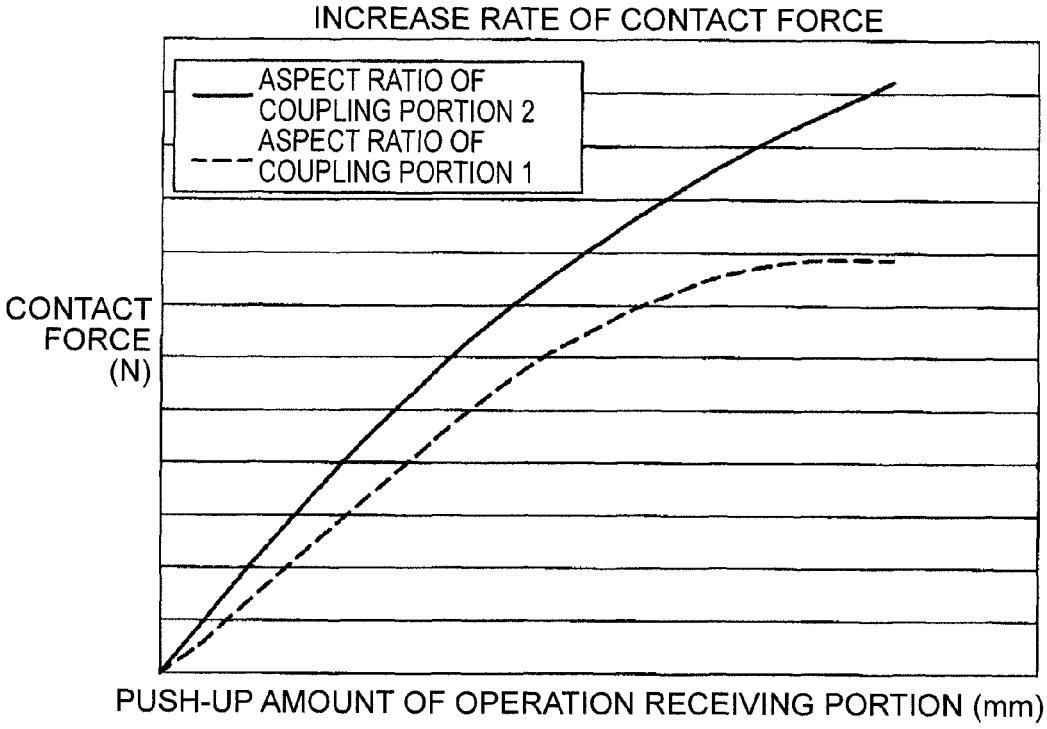
FIGS. 12A and 12B are graphs showing the operability of the connector connection terminal according to one or more embodiments of the present invention.

As shown in FIG. 12A, if the push-up amount at the operation receiving portion is the same, larger contact force is obtained in the first example than in the first comparative example.

Figure 12B:
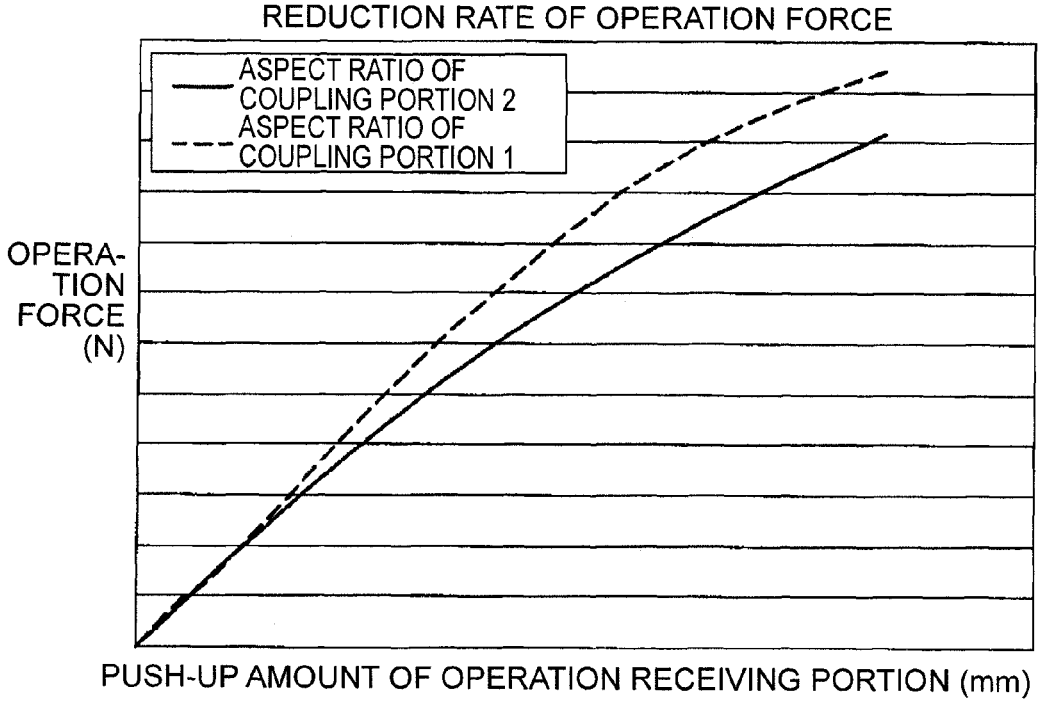

As shown in FIG. 12B, if the push-up amount at the operation receiving portion is the same, the operation can be performed with a smaller operation force in the first example than in the first comparative example.

In other words, operation can be lightly performed and the connection state can be maintained with a strong force.

In regards to the second connection terminal 30, with the cross-sectional area of the coupling portion 32 as the aspect ratio 2 (second example) and the aspect ratio 1 (second comparative example), the operability in a case where the operation receiving portion 38 was operated with the operation lever 40 was simulated. The calculation result is shown in FIG. 13.

Figure 13:
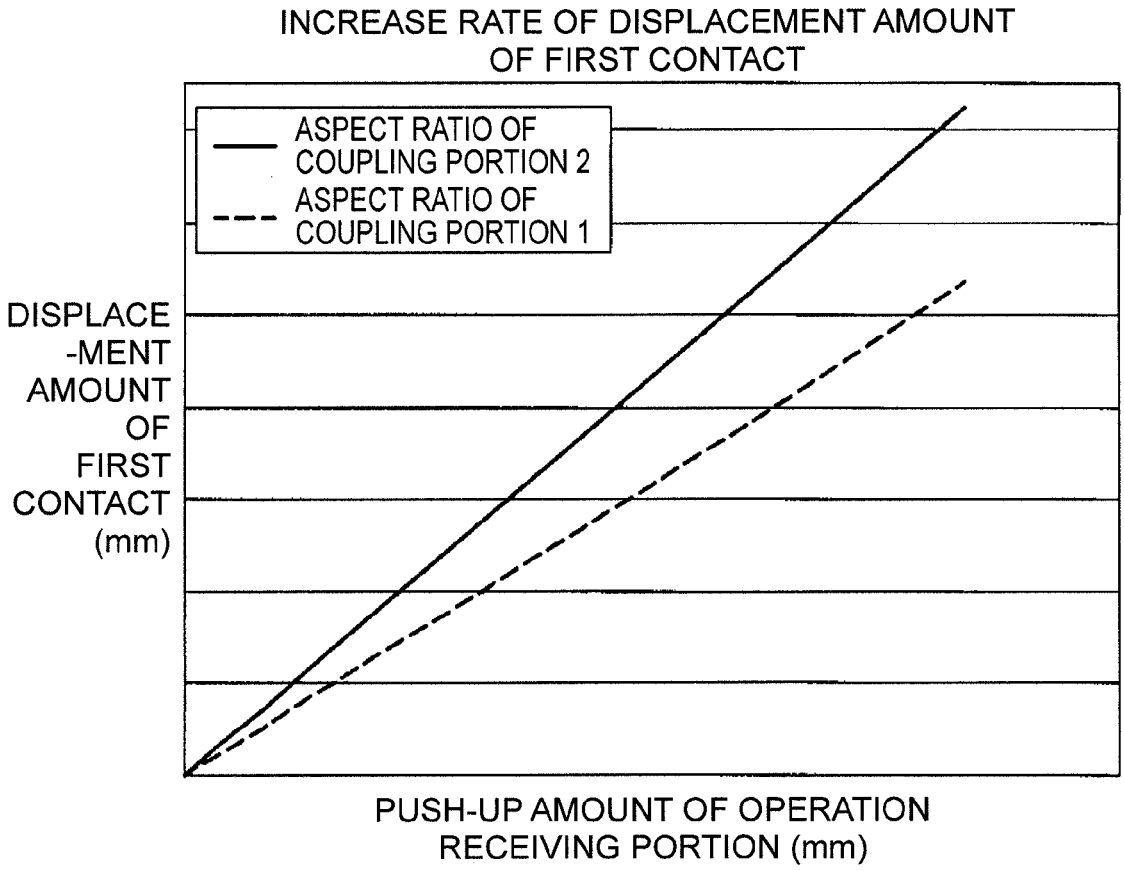
FIG. 13 is a graph showing the operability of the connector connection terminal according to one or more embodiments of the present invention.

As shown in FIG. 13, if the push-up amount at the operation receiving portion 38 is the same, greater displacement amount is obtained in the second example than in the second comparative example.

The coupling portions 22, 32 of the first and second connection terminals 20, 30 may not necessarily be straight and may be curved.

The connector connection terminal according to the present invention is not limited to the above described embodiments, and may have a shape that can be incorporated to another connector.

The coupling portion of the connector connection terminal according to the present invention is not limited to one having a uniform width dimension, and may have a shape that has a thick base and that becomes thinner towards the upper side.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector connection terminal comprising:

a fixed piece to be inserted to a base of a connector, a coupling portion extending from the fixed piece, and a movable piece extending in parallel to the fixed piece to both sides from a free end of the coupling portion and being operated by an operation lever rotatably assembled to the base, wherein at least one of the fixed piece and the movable piece includes at least one pointed portion;

and wherein the connector connection terminal is formed through electroforming.

2. The connector connection terminal according to claim 1, wherein a cutout is formed on the fixed piece.

3. The connector connection terminal according to claim 2, wherein an edge on one side of the cutout is the pointed portion.

4. The connector connection terminal according to claim 2, wherein an aspect ratio of a cross-sectional area of a bottom of the cutout is greater than or equal to 1.2.

5. The connector connection terminal according to claim 3, wherein an aspect ratio of a cross-sectional area of a bottom of the cutout is greater than or equal to 1.2.

6. The connector connection terminal according to claim 1, wherein a plurality of pointed portions is arranged side by side to form a saw-tooth shape.

7. The connector connection terminal according to claim 2, wherein a plurality of pointed portions is arranged side by side to form a saw-tooth shape.

8. The connector connection terminal according to claim 3, wherein a plurality of pointed portions is arranged side by side to form a saw-tooth shape.

9. The connector connection terminal according to claim 4, wherein a plurality of pointed portions is arranged side by side to form a saw-tooth shape.

10. The connector connection terminal according to claim 5, wherein a plurality of pointed portions is arranged side by side to form a saw-tooth shape.

11. The connector connection terminal according to claim 1, wherein a thickness of the pointed portion is thinner than a main body of the connector connection terminal.

12. The connector connection terminal according to claim 6, wherein a step is formed on one surface of the pointed end portion for thinning.

13. The connector connection terminal according to claim 6, wherein a step is formed on both surfaces of the pointed portion for thinning.

14. The connector connection terminal according to claim 6, wherein a thickness of the pointed portion is thinned by gradually reducing the thickness of the main body of the connector connection terminal.

15. A connector comprising a base and the connector connection terminal according to claim 1 in the base, wherein the connector connection terminal is configured to be operated by an operation lever.

* * * * *

UNITED STATES PATENT AND TRADEMARK OFFICE

CERTIFICATE OF CORRECTION

PATENT NO. : 7,896,675 B2
APPLICATION NO. : 12/572166
DATED : March 1, 2011
INVENTOR(S) : Yoshinobu Hemmi et al.

It is certified that error appears in the above-identified patent and that said Letters Patent is hereby corrected as shown below:

In the claims, claim 12, column 9, line 11, the word "end" should be omitted.

Signed and Sealed this
Thirty-first Day of May, 2011

David J. Kappos

David J. Kappos
*Director of the United States Patent and Trademark Office*